US008297084B2

(12) United States Patent
Park et al.

(10) Patent No.: US 8,297,084 B2
(45) Date of Patent: Oct. 30, 2012

(54) DRUM WASHING MACHINE

(75) Inventors: Yong Suck Park, Changwon-si (KR); Ig Geun Kweun, Changwon-si (KR); Kyu Hwan Lee, Busan (KR)

(73) Assignee: LG Electronics Inc., Seoul (KR)

( * ) Notice: Subject to any disclaimer, the term of this patent is extended or adjusted under 35 U.S.C. 154(b) by 777 days.

(21) Appl. No.: 12/299,195

(22) PCT Filed: May 2, 2006

(86) PCT No.: PCT/KR2006/001636

§ 371 (c)(1),
(2), (4) Date: Oct. 31, 2008

(87) PCT Pub. No.: WO2007/126170

PCT Pub. Date: Nov. 8, 2007

(65) Prior Publication Data

US 2009/0288455 A1 Nov. 26, 2009

(51) Int. Cl.
*D06F 37/00* (2006.01)

(52) U.S. Cl. ..... 68/140

(58) Field of Classification Search ..... 68/212, 68/23 R, 24, 140

See application file for complete search history.

(56) References Cited

U.S. PATENT DOCUMENTS

| | | | | |
|---|---|---|---|---|
| 3,270,529 | A * | 9/1966 | Engel | 68/18 F |
| 6,460,382 | B1 * | 10/2002 | Kim et al. | 68/140 |
| 2003/0006665 | A1 * | 1/2003 | Kim et al. | 310/231 |
| 2004/0163428 | A1 * | 8/2004 | Kim et al. | 68/140 |
| 2005/0028567 | A1 * | 2/2005 | Kim et al. | 68/140 |

FOREIGN PATENT DOCUMENTS

| | | |
|---|---|---|
| DE | 10342262 | 11/2004 |
| DE | 10350794 | 6/2005 |
| EP | 1477605 | 11/2004 |
| EP | 1602768 | 12/2005 |
| KR | 10-2001-0037517 | 5/2001 |
| KR | 10-2001-0037518 | 5/2001 |
| KR | 2004/020715 | 3/2004 |
| KR | 10-2004-0050490 | 6/2004 |
| KR | 10-2005-00532 11 | 6/2005 |

OTHER PUBLICATIONS

International Search Report dated Feb. 17, 2009.
Written Opinion of the International Searching Authority dated Feb. 17, 2009.
Korean Office Action dated Oct. 28, 2010 (Application No. 10-2008-7025777).
German Office Action dated Mar. 28, 2012 with English Translation.

* cited by examiner

*Primary Examiner* — Joseph L Perrin
(74) *Attorney, Agent, or Firm* — Ked & Associates LLP

(57) ABSTRACT

A drum washing machine is provided. The drum washing machine includes a tub that stores wash water therein, a drum rotatably mounted within the tub, a motor mounted in a rear of the tub, the motor having a shaft to rotate the drum, a bearing housing inserted into the tub having a hollow portion, which allows the shaft of the motor to pass therethrough, formed in a center thereof, a bearing secured to the hollow of the bearing housing, and an outlet hole that discharges gas or moisture generated in the bearing and a portion adjacent to the bearing outside of the bearing housing. The drum washing machine so constructed has enhanced durability, because it includes the outlet hole provided in the bearing housing where the shaft rotates that prevents moisture or water from remaining in the bearing housing.

23 Claims, 6 Drawing Sheets

[Fig. 1]
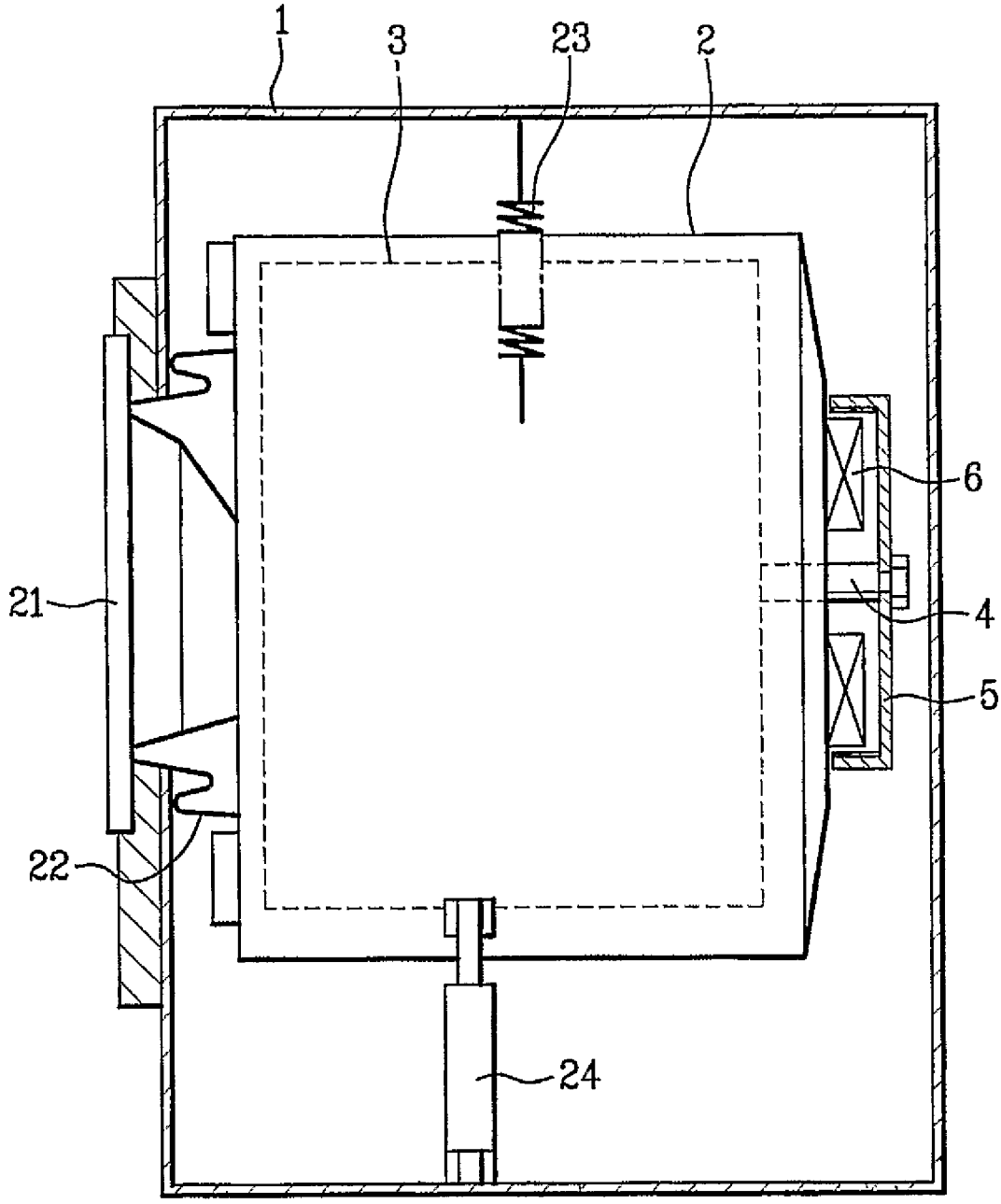

[Fig. 2]
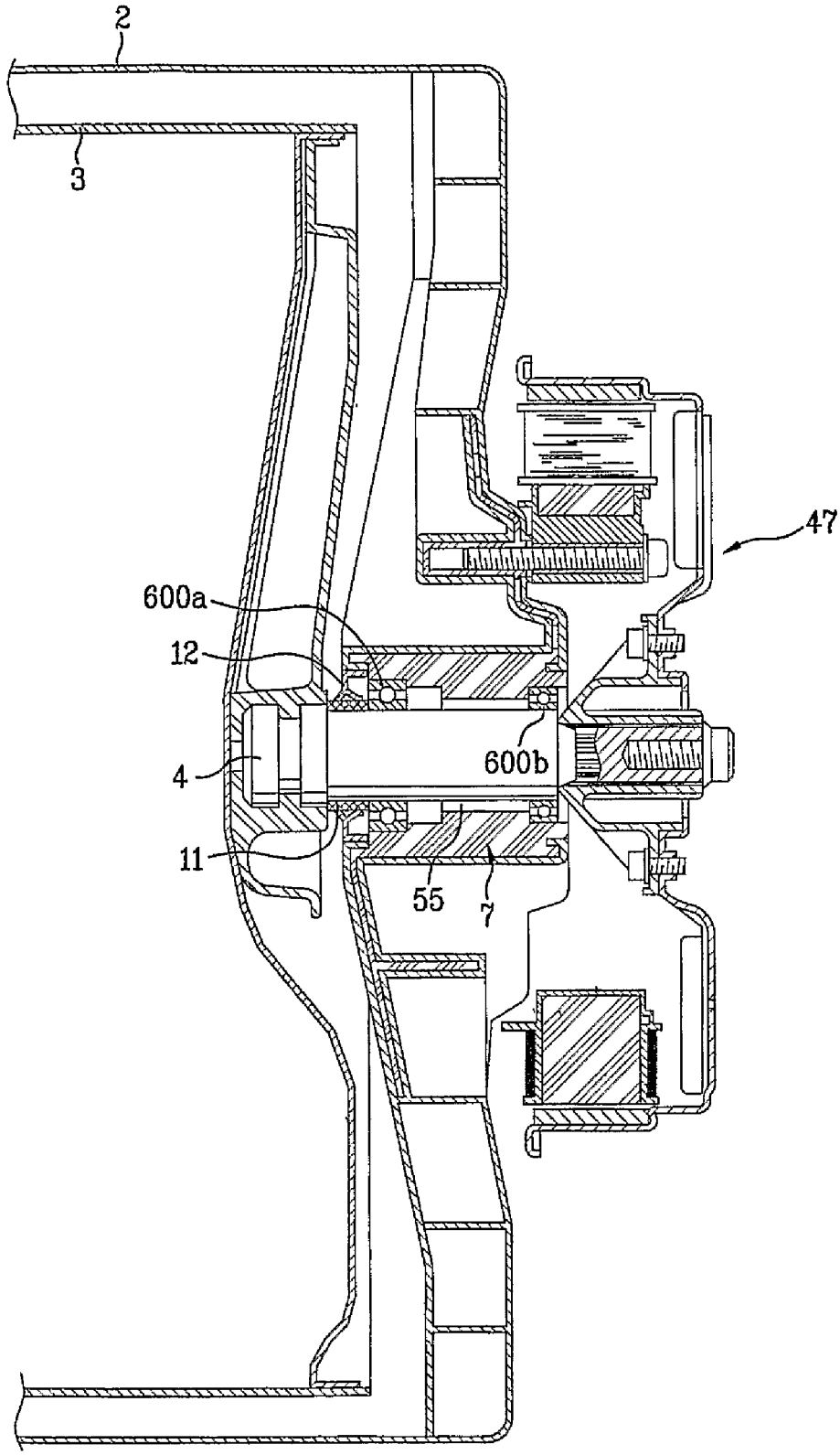

[Fig. 3]
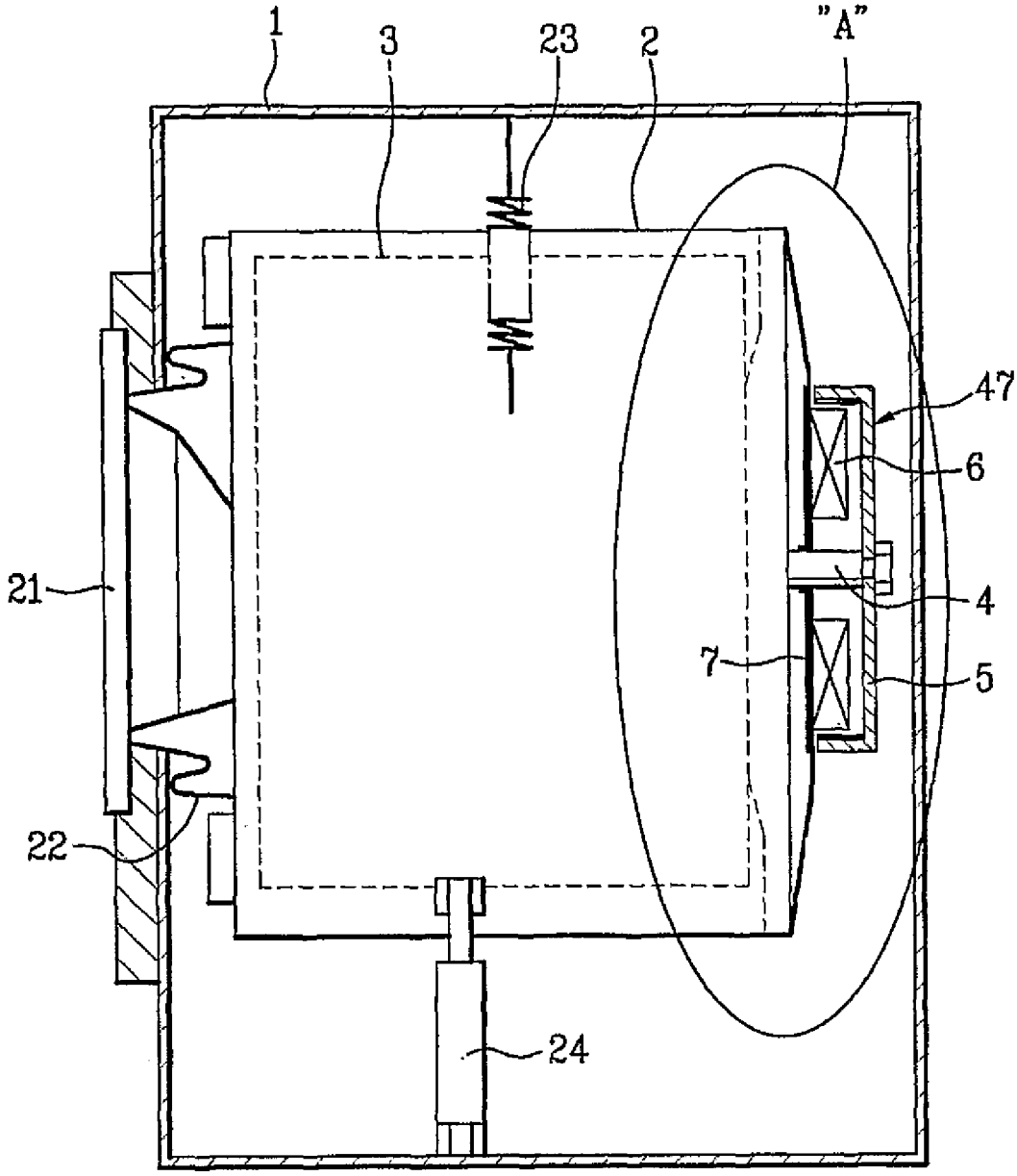

[Fig. 4]
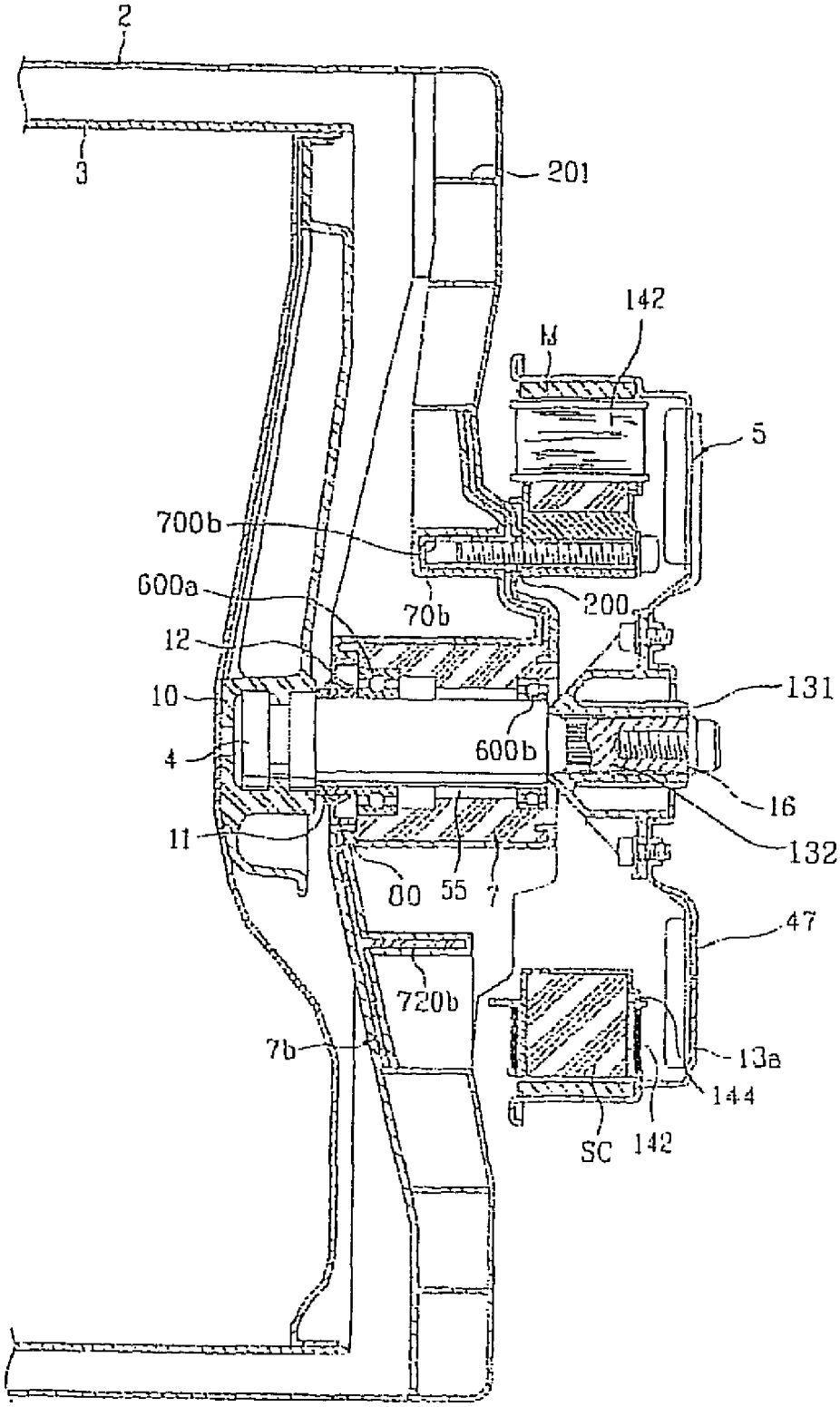

[Fig. 5]
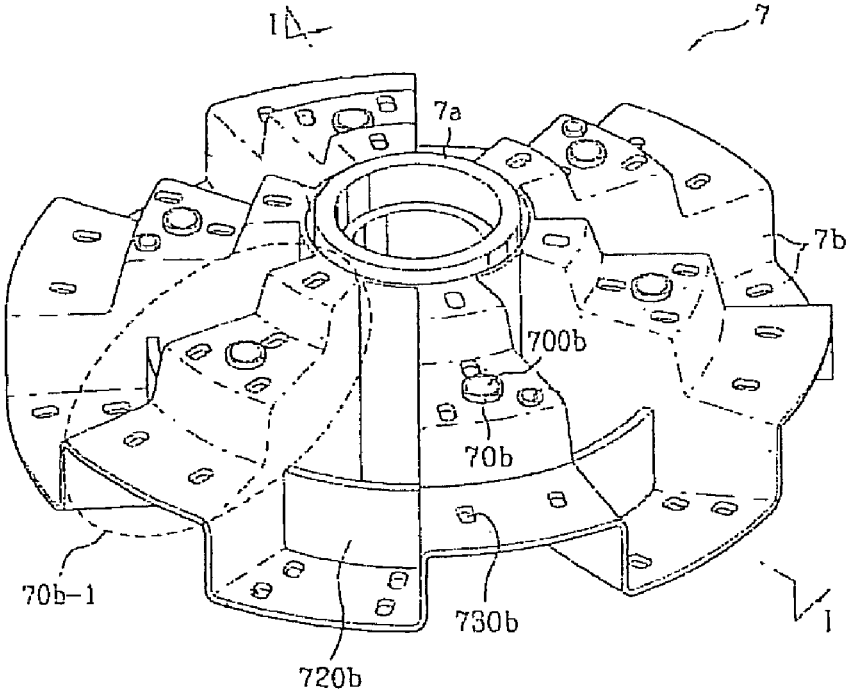
[Fig. 6]
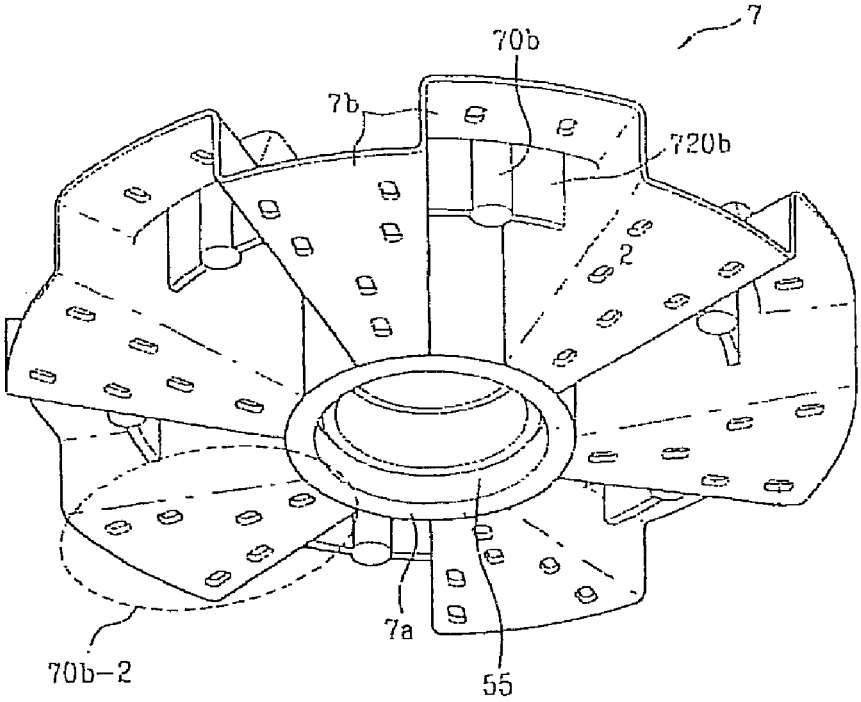

[Fig. 7]
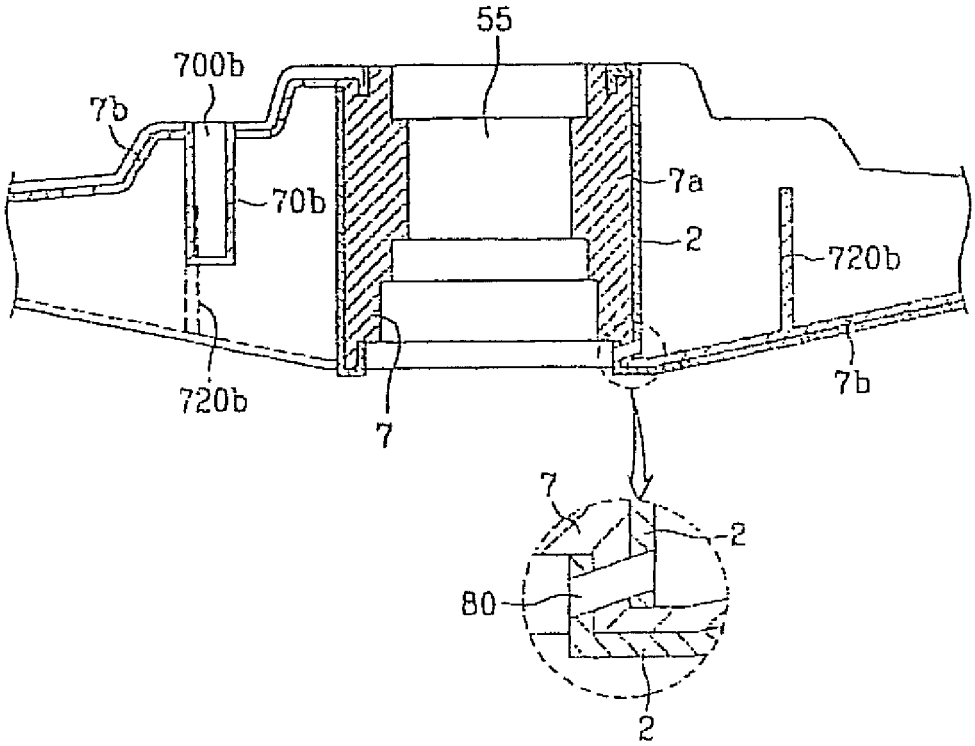

DRUM WASHING MACHINE

TECHNICAL FIELD

The present invention relates to a washing machine, and more particularly, to a drum washing machine having an outlet hole to prevent a portion where a bearing housing is provided from being damp.

BACKGROUND ART

In general, a washing machine performs washing by rotating a drum having laundries therein through a driving force transmitted by a motor in a state where detergent and the laundry are mixedly loaded into a drum.

Recently, a drum washing machine has been preferably used, which washes the laundry by using friction force between a rotating drum and the laundry, because the drum washing machine has a washing effect as if the laundry were scrubbed and washed by human hands and another washing effect that the laundry may not be entangled.

The drum washing machine is classified by a driving method into an indirect-motor-drive type and a direct-motor drive type. According to the indirect-motor drive type washing machine, the driving force of motor is indirectly transmitted to a drum through a motor pulley and a belt wound around a drum pulley. According to the direct-motor-drive type drum washing machine, the driving fore of motor is directly transmitted to a drum, because a rotor of a BLDC motor is directly connected with the drum.

Referring to FIG. 1, a conventional direct-drive motor type drum washing machine will be schematically described.

FIG. 1 is a longitudinal sectional view illustrating a structure of a conventional drum washing machine. The conventional drum washing machine includes a cabinet 1 defining an exterior thereof, a tub 2 mounted within the cabinet 1 with a front side opened and a drum 3 rotatably mounted in an inner center of the tub 2.

Moreover, a motor 47 having a stator 6 and a rotor 5 is mounted in a rear wall of the tub 2. The stator 6 is secured to a rear wall of the tub 2 and the rotor 5 passes through the tub 2 with surrounding the stator 6 and is connected with the drum 3 by a shaft 4.

Together with that, a tub supporter in the same appearance as an exterior of the rear wall of the tub 2 is provided between the rear wall of the tub 2 and the stator 6, and fastened to the rear wall of the tub 2 to support the load of the stator 6 when fastening the stator 6. Also, the tub supporter is made of metal to maintain the concentricity of the stator 6.

Meanwhile, a door 21 is coupled to a front side of the cabinet 1, and a gasket 22 is provided between the door 21 and the tub 2.

In addition, a hanging spring 23 is provided between an upper inner surface of the cabinet 1 and an upper circumferential surface of the tub 2 to support the tub 2. Also, a friction damper 24 is provided between an inner lower surface of the cabinet 1 and a lower portion of the outer circumferential surface of the tub 2 to dampen the vibration of tub 2 generated in spinning.

Referring to FIG. 2, a bearing housing 7 having a hollow 55 formed in a center thereof is inserted into the tub 2. The shaft 4 of the motor 47 passes through the hollow 55.

At that time, the bearing housing 7 is made of aluminum alloy and formed as one body with the rear wall of the tub 2 by being inserted into the rear wall of the tub 2 when injection-molding the tub 2 with plastic resin.

Also, the beating housing 7 has bearings 600*a* and 600*b* secured to an opposite she sides of the hollow 55.

Also, a bushing 11 made of brass, which is rust-resistant, is provided at a front bearing 600*a* secured to the drum 3, and a sealing member 12 is provided on an outer surface of the bushing 11 to prevent moisture from percolating toward the front bearing 600*a*.

However, the conventional drum washing machine has following problems.

The conventional drum washing machine has a problem that moisture regardless of a small amount may percolate toward the front bearing 600*a* of the drum 3 even though the sealing member 12, because the power is applied to rotate the drum 3 and wash water is filled up within the tub 2 in the beginning of the washing process.

Especially, if the small amount of the percolating moisture is easily changed into water because of the high temperature of the portion around the shaft caused by the high speed rotation of the drum 3, the water could be pooled in a portion adjacent to the front bearing 600*a*.

In that case, the metal around the front bearing 600*a* may become rusty due to the percolating moisture or water and also oil may be mixed with the water, thereby deteriorating durability or generating noise.

DISCLOSURE OF INVENTION

Technical Problem

An object of the present invention devised to solve the problem is to prevent water or moisture from remaining within a bearing housing having a bearing provided therein.

Technical Solution

To achieve these objects and other advantages and in accordance with the purpose of the invention, as embodied and broadly described herein, a drum washing machine includes a tub for storing wash water therein; a drum rotatably mounted within the tub; a motor mounted in rear of the tub, the motor having a shaft to rotate the drum; a bearing housing inserted into the tub with a hollow 55 allowing the shaft of the motor to pass through formed in a center thereof; a bearing secured to the hollow of the bearing housing; and an outlet hole for discharging gas or moisture generated in the bearing and the adjacent portion of the bearing to and outside of the bearing housing.

Here, the outlet hole passes through the bearing housing and makes the moisture discharged to an outside of the tub through the outlet hole of the bearing housing.

The bearing housing may be inserted into the tub and the bearing housing and the tub are in communication each other by, the outlet hole which the moisture is discharged to the outside of the tub through.

At least one outlet hole is formed in the bearing housing.

At least one of the outlet holes is provided in a lower portion of a vertical line passing through the center of the bearing housing.

An end of the bearing housing is inserted to some part of the hollow of the bearing housing.

The end of the bearing housing inserted to some part of the hollow is the end which is adjacent to the drum.

Advantageous Effects

A drum washing machine according to the present invention has an advantageous effect of enhancing durability thereof, because the drum washing machine includes the outlet hole provided in the bearing housing where the shaft is rotated to prevent moisture or water from remaining in the bearing housing.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a sectional view schematically illustrating a conventional drum washing machine.

FIG. 2 is a side-sectional view subdividedly illustrating the structure of mounting a motor in a tub according to the conventional drum washing machine.

FIG. 3 is a sectional view schematically illustrating key parts of a drum washing machine according to the present invention.

FIG. 4 is an enlarged sectional view illustrating an A portion of FIG. 3.

FIG. 5 is a perspective view illustrating a bearing housing inserted into a tub.

FIG. 6 is a perspective view illustrating a rear surface of the bearing housing of FIG. 5.

FIG. 7 is a sectional view illustrating a fastening structure between the tub having an outlet hole and the bearing housing.

BEST MODE FOR CARRYING OUT THE INVENTION

Reference will now be made in detail to the preferred embodiments of the present invention, examples of which are illustrated in the accompanying drawings.

Referring to FIGS. 3 to 7, preferred embodiments of the present invention will be described in detail.

The same components of each embodiment will have the same references and names as follows.

First of all, referring to FIGS. 3 to 7, a structure of a rear wall of a tub according to the present invention will be described.

FIG. 3 is a sectional view schematically illustrating key parts of a drum washing machine according to the present invention. FIG. 4 is an enlarged sectional view illustrating an A portion of FIG. 3.

FIG. 5 is a perspective view of a bearing housing inserted into a tub. FIG. 6 is a perspective view illustrating a rear surface of the bearing housing of FIG. 5. FIG. 7 is a sectional view illustrating a fastening structure between the tub having an outlet hole and the bearing housing.

As shown in FIGS. 3 and 4, a drum washing machine according to the present invention includes a cabinet 1 that defines an exterior thereof, a tub 2 mounted within the cabinet 1 to hold wash water therein, a drum 3 rotatably mounted within the tub 2, a motor 47 mounted in or at a rear of the tub 2 and having a shaft 4 that rotates the drum 3, a bearing housing 7 inserted into the tub 2 and having a hollow 55, which allows the shaft 4 of the motor 47 to pass therethrough, formed in a center thereof, a bearings 600*a* and 600*b* provided on opposite sides of the hollow 55, respectively, an outlet hole 80 that discharges gas or moisture generated in the bearing or a portion adjacent to the bearing to an outside of the bearing housing 7.

The hollow 55 of the bearing housing 7 has short steps formed on the opposite ends thereof to fixedly secure the bearings 600*a* and 600*b* on the hollow 55.

Also a door 21 is coupled in front of the cabinet 1, and a gasket 22 is provided between the door 21 and the tub 2.

Also, a hanging spring 23 supporting the tub 2 is installed between an inner portion of an upper surface of the cabinet 1 and an upper portion of an outer circumferential surface of the tub 2. A friction damper 24 is installed between an inner portion of the lower surface of the cabinet 1 and a lower portion of the outer circumferential surface of the tub 2 to dampen the vibration of the tub 2 generated in spinning.

Here, the tub 2 is made of plastic such as resin, and the bearing housing 7 is made of aluminum alloy, such that the bearing housing 7 may be inserted into the rear wall of the tub 2 as one body when injection-molding the tub 2.

Referring to FIG. 4, the bearing housing 7 as one body with the tub 2 is formed to allow a stator fastening part 7*b* extendedly formed toward a radial direction from a rear end of the bearing housing 7 to be inserted into the rear wall of the tub 2. At that time, a stator fastening hole 700*b* formed in the stator fastening part 7*b* is exposed to an outside.

In addition, as shown in FIGS. 5 and 6, the stator fastening part 7*b* of the bearing housing 7 extends toward the outside in the radial direction from the bearing housing 7 having a sleeve shape, and includes stepped areas 70*b*-1 stepped at least one time as it extends outwardly in the radial direction.

Furthermore, the stator fastening part 7*b* of the bearing housing 7 includes planar areas 70*b*-2 provided between the stepped areas 70*b*-1.

The stepped area areas 70*b*-1 and the planar areas 70*b*-2 of the stator fastening part 7*b* are connected to each other.

That is, the stator fastening part 7*b* of the bearing housing 7 includes the stepped areas 70*b*-1 having the stepped structure as it extends outwardly in the radial direction, and the planar areas 70*b*-2 having a planar structure provided between the stepped areas 70*b*-1. The planar areas 70*b*-1 are stepped every predetermined distance outwardly in the radial direction, and extend outwardly toward the radial direction from the upper end of bearing support part 7*a*. The planar areas 70*b*-2 of the stator fastening portion are planar and are connected with the lower end of the bearing housing 7.

Referring to FIG. 4, a projecting boss 200 is formed in a portion corresponding to the portion adjacent to the fastening hole 700*b* provided in the stator fastening part 7*b* of the rear wall of the tub 2 to prevent the stator fastening part 7*b* from directly touching the stator 6, thereby preventing the insulator of the stator 6 from being damaged by the fastening force applied in fastening the stator 6.

Preferably, a rib 720*b* is formed in a portion spaced apart at a predetermined distance from the center of the bearing housing 7 along a circumferential direction. Preferably, a fastening boss 70*b* having the stator fastening hole 700*b* is provided on the rib 720*b*. However, it is preferred but not necessary that the fastening hole 700*b* is formed on the rib 720*b*.

Together with that, a reinforcing rib 201 for reinforcing the strength of the rear wall of the tub 2 is formed in the other area except the stepped area of the bearing housing 7 of the rear wall of the tub 2 in a circumferential and radial direction.

A front end of the shaft 4 is fastened to a spider 10 provided in a rear wall of the drum 3. A bushing 11 made of brass to prevent rust is provided from the portion of the tub 2 exposed in rear of the spider 10 to the front bearing 600*a*. A sealing member 12 is provided on an outer surface of the bushing 11 to prevent the moisture from percolating toward the front bearing 600*a*.

Meanwhile, a rotor 5 included in a direct-drive motor is fastened to the center of the rear end of the shaft 4, and a stator 6 included in the direct-drive motor together with the rotor 5 is fixedly fastened to the rear wall of the tub 2.

At that time, the rotor 5 made of steel has a bent part formed on a side wall of the rear wall extended forwardly from an edge of the rear wall 13*a* to support a magnet (M) mounted in front of the inside of the rear wall in circumferential direction, as shown in FIG. 4.

Also, a connector 16 is fastened to an edge of the through-hole 131 formed in a hub part 132 of the rotor 5 to be serration-connected on an outer circumferential surface of a rear end of the shaft 4 exposed backwardly from the rear bearing 600*b*.

The connector 16 is made of resin material which has a different vibration mode from that of the rotor 5 made of steel, and employed as a bushing for the rotor 5.

The hub part 132 is provided on the rear wall of the tub 2 to have the bearing housing 7 inserted therein when injection-molding the tub 2.

The stator 6 included in the direct-drive motor together with the rotor 5 is injection-molded as one body with a spiral core (SC), an insulator 144 surrounding the spiral core (SC) and a coil 142 wound around a teeth of the spiral core (SC).

The spiral core (SC) is formed in a multi-layer structure, because of rotating and winding a steel plate having a teeth and a base from the bottom to the top thereof.

An end of the bearing housing 7 toward the drum 3 is inserted into some part of the inner side of the hollow 55 of the bearing housing 7 provided in the tub 2, and the other end of the bearing housing 7 toward the motor 47 is molded in a state where the hollow 55 is exposed.

Furthermore, an outlet hole 80 is provided in the drum washing machine according to the present invention to discharge gas or moisture generated in the front bearing 600*a* as well as the adjacent portion thereto to an outside, not to remain in the hollow 55 of the bearing housing 7.

The outlet hole 80 may be provided in a drum 3, because washing is performed in the drum 3 and moisture percolating is caused in the drum 3.

As described above, the bearing housing 7 is in communication with the portion of the tub 2 having the bearing housing 7 inserted therein.

Meanwhile, the outlet hole 80 may be provided more than two, and preferably at least one outlet hole 80 is provided in a lower portion of the vertical line passing the center of the bearing housing 7 to allow the moisture generated in the high-speed rotation to be discharged downwardly due to the weight of itself.

The operation according to the embodiments of the present invention with the above configuration will be described.

Firstly, an electric current is applied to the coil 142 of the stator 6 by a controller (not shown) attached to a panel part for driving the motor 47 and the rotor 5 is rotated. Hence, the connector 16 fastened to the rotor 5 and the shaft 4 connected with the rotor by the serration are rotated, and the power is transmitted to the drum 3 through the shaft 4, thereby rotating the drum 3.

By the way, the moisture percolating through the sealing member 12 inward the hollow 55 of the bearing housing 7 is discharged to an outside of the tub 2 through the outlet hole 80.

That is, the moisture generated in the drum 3 is percolating into the bearing 600*a* and might make the bearing housing 7 rusty. Thus, the moisture is discharged to the outside of the tub 2 from the hollow 55 of the bearing housing 7 to prevent the above problem.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

Since the present invention includes the outlet hole provided in the bearing housing where the shaft is rotated to prevent moisture or water from remaining in the bearing housing, the present invention has an industrial applicability of enhancing durability thereof.

The invention claimed is:

1. A direct-motor-drive type drum washing machine, comprising:

a tub that stores wash water therein;

a drum rotatably mounted within the tub;

a motor coupled the tub, the motor having a shaft to rotate the drum;

a bearing housing coupled to the tub and having a hollow space, wherein the shaft of the motor passes through the hollow space;

at least one bearing secured within the hollow space of the bearing housing; and at least one outlet hole passing through the bearing housing, wherein the outlet hole has an inlet in communication with the hollow space and an outlet in communication with an area outside the bearing housing, and wherein moisture or water inside the hollow space travels into the inlet and through the outlet of the outlet hole to the area outside the bearing housing.

2. The drum washing machine of claim 1, wherein the bearing housing and the tub are in communication with each other and wherein the area outside the bearing housing in an area outside of the tub.

3. The drum washing machine of claim 1, wherein:

the bearing housing has a first surface in opposing relation to a second surface, the first surface is an upper surface and the second surface is a lower surface of the bearing housing, and the outlet of the at least one outlet hole passes through the second surface of the lower housing.

4. The drum washing machine of claim 1, wherein one end of the bearing housing that extends toward the drum is inserted into the tub, and the other end of the bearing housing that extends toward the motor is exposed.

5. The drum washing machine of claim 4, wherein the tub is made of a material that includes a plastic resin and the bearing housing is made of a material that includes metal.

6. The drum washing machine of claim 5, wherein the bearing housing is inserted into a rear wall of the tub to be formed as one body with the tub when the tub is injection molded.

7. The drum washing machine of claim 5, wherein the metal is an aluminum alloy.

8. The drum washing machine of claim 1, wherein the at least one bearing comprises a plurality of bearings, and wherein the hollow space of the bearing housing includes a plurality of steps formed on opposite ends thereof to fixedly secure the plurality of bearings within the hollow space.

9. The drum washing machine of claim 1, wherein the bearing housing includes a stator fastening part that extends in a radial direction from an end of the bearing housing, and wherein a plurality of stator fastening holes to which a stator of the motor is fastened is formed in the stator fastening part.

10. The drum washing machine of claim 9, wherein the bearing housing is formed as one body with the tub such that the stator fastening part is inserted into a rear wall of the tub and the plurality of stator fastening holes is exposed to the outside.

11. The drum washing machine of claim 10, wherein the tub is made of a material that includes a plastic resin and the bearing housing is made of a material that includes an aluminum alloy.

12. The drum washing machine of claim 1, wherein the motor comprises a stator and a rotor.

13. The drum washing machine of claim 12, wherein the rotor is mounted on the shaft and the stator is mounted to a rear wall of the tub.

14. The drum washing machine of claim 13, wherein the shaft passes through the tub and is coupled to the drum.

15. The drum washing machine of claim 14, wherein the shaft is coupled to a spider provided in a rear wall of the drum.

16. The drum washing machine of claim 13, wherein the rotor is made of a material that includes steel and is coupled to the shaft by a connector made of a material that includes resin.

17. The drum washing machine of claim 1, wherein the inlet of the outlet hole is located adjacent the at least one bearing in the hollow space of the bearing housing.

18. The drum washing machine of claim 17, wherein the inlet of the outlet hole is located between the at least one bearing and a rear wall of the drum.

19. The drum washing machine of claim 18, wherein the moisture or water travels from an interior of the drum along the shaft to the outlet hole and wherein the moisture or water enters the inlet of the outlet hole so as not to pass to the at least one bearing.

20. The drum washing machine of claim 19, wherein the moisture or water traveling along the shaft passes through a sealing member adjacent the hollow space of the bearing housing prior to entering the inlet of the outlet hole.

21. The drum washing machine of claim 1, wherein the moisture or water travels into the inlet of the outlet hole as a result of gravitational force.

22. The drum washing machine of claim 1, wherein a portion of the outlet hole between the inlet and the outlet is slanted at a predetermined angle.

23. The drum washing machine of claim 1, wherein the outlet passes through a surface of the bearing housing that is at least substantially parallel to the shaft of the motor.

* * * * *